US005666888A

United States Patent [19]

Dame et al.

[11] Patent Number: 5,666,888

[45] Date of Patent: Sep. 16, 1997

[54] ADJUSTABLE WORK SURFACE

[75] Inventors: Paul G. Dame; David A. Immink, both of Holland, Mich.; Walter K. Klaiber, Hausen; Konrad Merkt, Spaichingen, both of Germany

[73] Assignee: Herman Miller Inc., Zeeland, Mich.

[21] Appl. No.: 326,109

[22] Filed: Oct. 19, 1994

[51] Int. Cl.[6] ..... A47B 9/00

[52] U.S. Cl. ..... 108/144; 108/143; 248/407; 248/188.2; 384/42

[58] Field of Search ..... 108/144, 137, 108/143, 102, 106, 147; 248/407, 408, 412, 188.5, 188.2, 429; 403/374, 109, 108, 409.1; 384/42, 17, 22, 23, 34; 312/334.16, 334.27, 334.36, 334.29, 334.31, 334.44, 334.24, 334.34, 334.46, 334.47, 333

[56] References Cited

U.S. PATENT DOCUMENTS

| | | | |
|---|---|---|---|
| 944,560 | 12/1909 | Joseph | 108/147 |
| 1,481,445 | 11/1924 | Swanson | 248/407 X |
| 2,570,183 | 10/1951 | Weber | 108/147 X |
| 3,774,872 | 11/1973 | Morelli | 108/147 X |
| 4,130,070 | 12/1978 | Herrin | 108/143 |
| 4,570,997 | 2/1986 | Tanizaki et al. | 248/429 X |
| 4,759,341 | 7/1988 | McFarland | 384/23 X |
| 4,838,181 | 6/1989 | Luyk | 108/143 X |
| 5,290,058 | 3/1994 | Adams et al. | 108/143 X |
| 5,467,721 | 11/1995 | Gosch | 108/144 X |

FOREIGN PATENT DOCUMENTS

| | | | |
|---|---|---|---|
| 2609776 | 7/1988 | France | 108/144 |
| 2013231 | 2/1973 | Germany | 384/34 |
| 1365966 | 9/1974 | United Kingdom | 384/34 |

*Primary Examiner*—Peter M. Cuomo
*Assistant Examiner*—Janet M. Wilkens
*Attorney, Agent, or Firm*—Brinks Hofer Gilson & Lione

[57] ABSTRACT

A height-adjustable work surface assembly including a movable work surface. A frame extends from beneath the work surface in order to provide support for the work surface. The frame has a support member directed downward from beneath the work surface. A leg is adjustably connected to the support member. A rack is connected to one of the support member and the leg. The rack includes a plurality of substantially horizontally extending teeth. An interlocking block is positioned adjacent the rack and within a cavity formed between the rack and the leg. The interlocking block is movable into and out of engagement with the rack. The cavity has a width greater than a width of the interlocking block and a width of one the teeth. A first fastening mechanism is connected to the interlocking block. The first fastening mechanism is horizontally movable such that the interlocking block is secured against the rack in a locked position and completely disengaged from the rack in an unlocked position.

26 Claims, 5 Drawing Sheets

FIG. 1
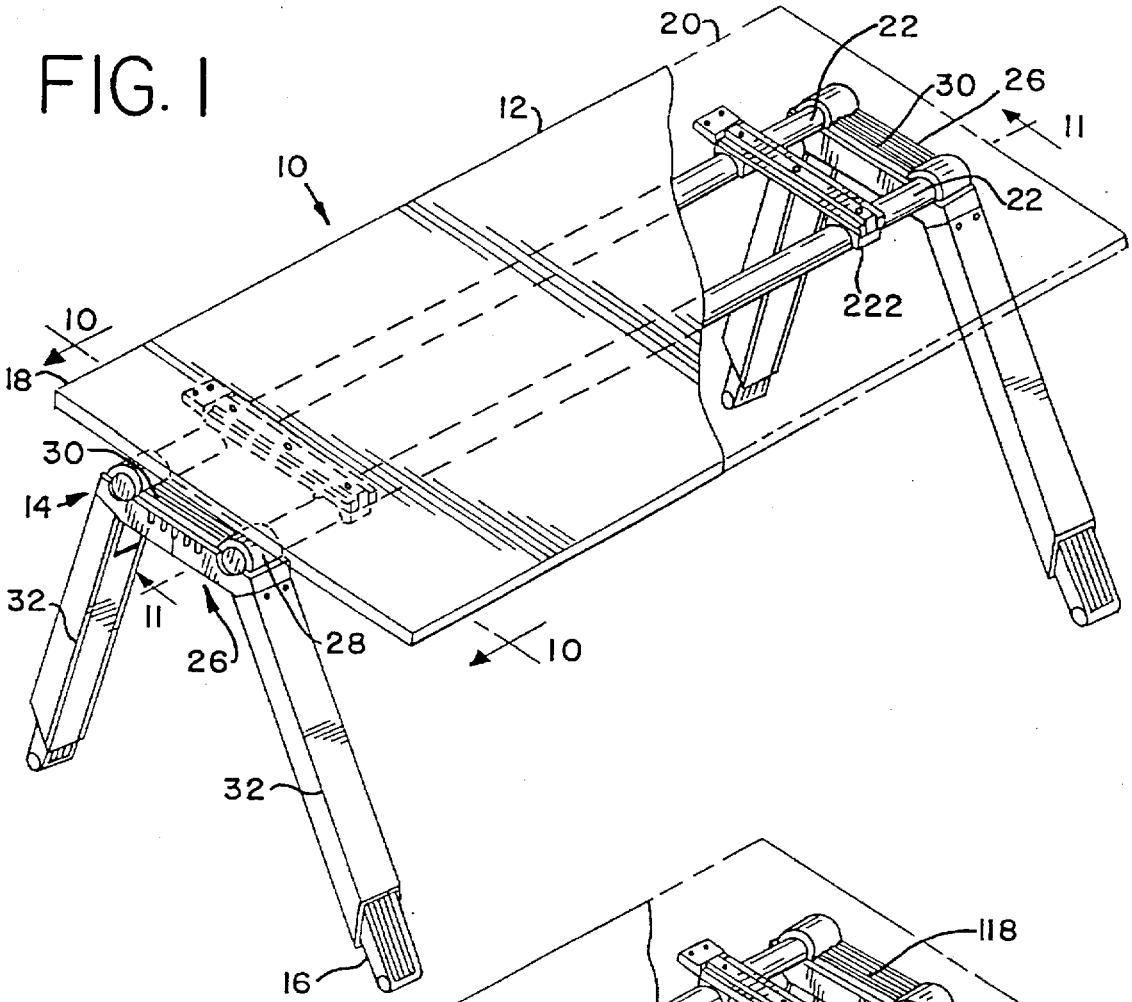
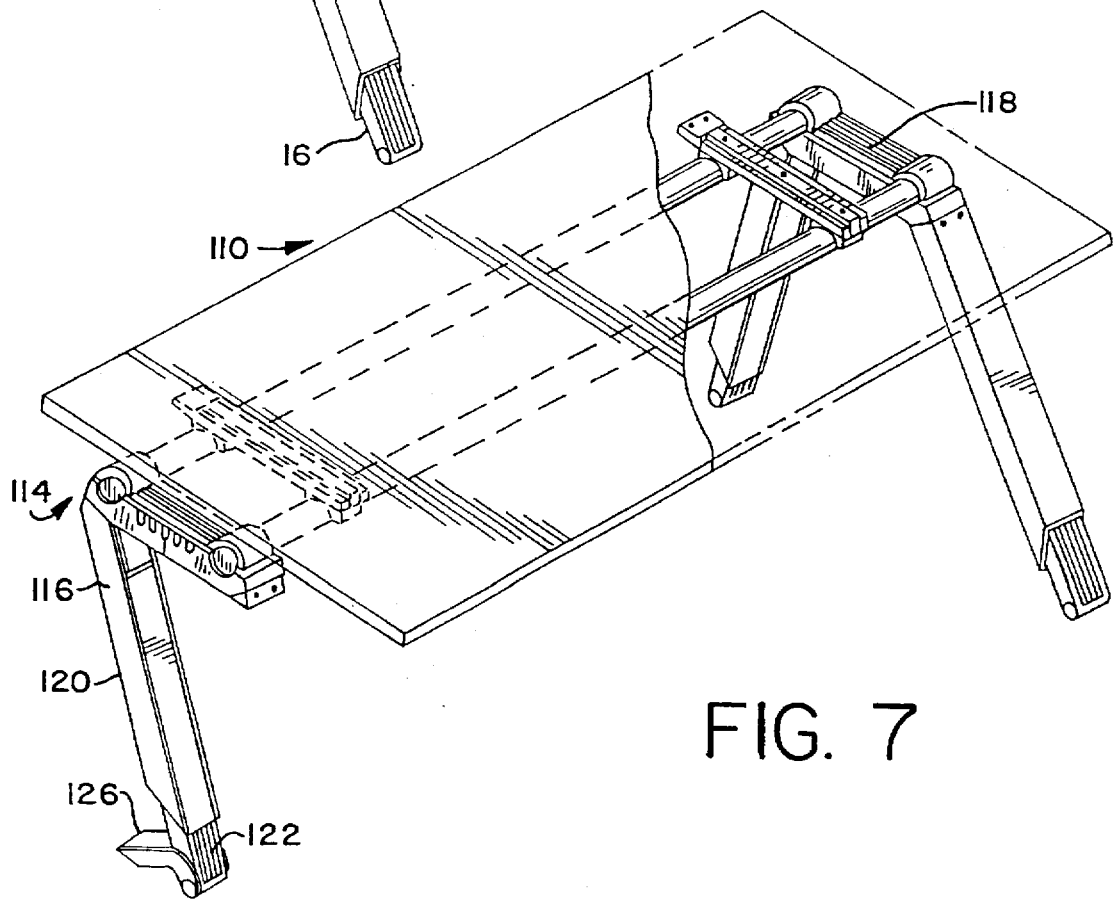
FIG. 7

FIG. 8
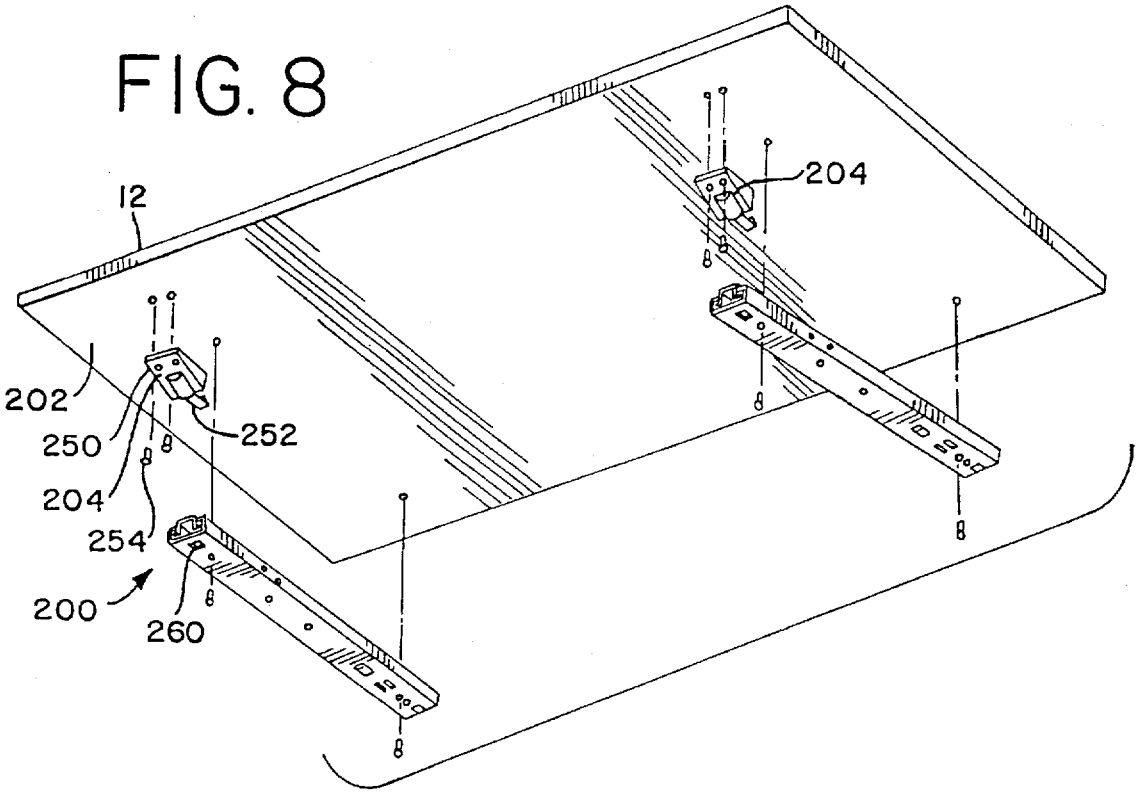
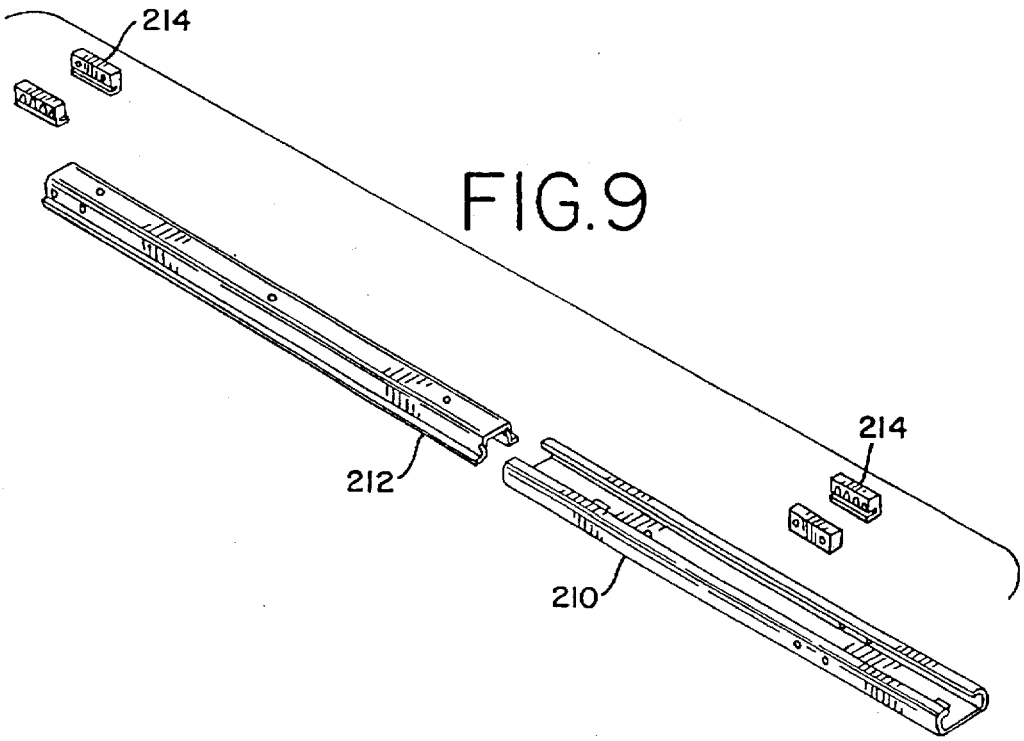
FIG. 9

ADJUSTABLE WORK SURFACE

BACKGROUND OF THE INVENTION

The present invention relates generally to the field of adjustable work surfaces. More particularly, the invention relates to a frame and leg for use with a work surface that includes a height-adjustment capability. In addition, this invention relates to a work surface that includes a horizontal-adjustment capability.

Work surfaces such as desks, drafting tables or supports for computer terminals are often designed to include a height-adjustment capability and/or a horizontal-adjustment capability. The productivity and the comfort level of the individuals using the work surface are increased if the height of the work surface can be adjusted to fit the needs of a particular user. Similarly, a work surface can be more readily configured for use with a computer or more generally, for power management, if the work surface is horizontally adjustable thereby allowing a user to have easier access to the area behind the work surface. Elaborate and/or inefficient arrangements for providing such adjustments have been prevalent in many diverse areas. In many cases, however, various adjustment mechanisms have provided for only a relatively small adjustment capability, or have been elaborate and costly while not increasing the overall comfort level of a particular user. Moreover, the complex mechanism of many height-adjustable work surfaces, for example, does not allow for adequate space beneath the work surface for a user's legs.

U.S. Pat. No. 4,651,652 issued to Wyckoff, for example, discloses an adjustable work desk having a complex height-adjustment mechanism. The disclosed work desk has a height-adjustable work surface that is raised by force applied through the interaction of a series of two pulley systems and a lockable gas spring. The gas spring is attached to the first pulley system to provide for the height adjustment of the work surface. The first pulley system is necessary to allow the work surface to achieve a height greater than that of the associated gas spring. The second pulley system works in cooperation with the first pulley system to allow the sides of the work surface to achieve the same overall height as the center of the work surface. Both pulley systems consist of numerous pulleys interconnected through a cable of braided wire. As a result, this complex mechanism is costly and difficult to produce and to assemble.

Accordingly, a simple and more versatile adjustable work surface is needed.

SUMMARY OF THE INVENTION

Briefly stated, the present invention is directed to a height-adjustable work surface assembly having a movable work surface. A frame extends from beneath the work surface in order to provide a support for the work surface. The frame has at least one sleeve directed downward from beneath the work surface and a leg adjustably received within the sleeve. The leg has a cavity with a rack secured therein. An interlocking block is positioned within the cavity for engagement along the length of the rack. A first fastening mechanism extends through the sleeve and leg, and is movably fastened to the block in order to secure the block in a given position against the rack. The work surface height may be adjusted by the relative positioning of the leg within the sleeve of the frame as determined by the relative positioning of the block along the length of the rack.

According to another aspect of the invention, a wedge with an angled surface is received within the cavity of the leg and the angled surface is positioned against an end of the rack. The end of the rack has an angled surface substantially corresponding to the angled surface of the wedge.

According to a further aspect of the invention, a horizontally-adjustable work surface assembly having a horizontally movable work surface is disclosed. A frame extends from beneath the work surface to provide support for the work surface. A fixed channel member is attached across the width of the frame and has an aperture therein. A movable slide member is attached to the bottom surface of the work surface and is movably received within the channel member. A lock member is attached to the bottom surface of the work surface adjacent the slide member. The lock includes a body and a latch member. The latch member extends outward from the body toward the channel member and is adapted to be received within the aperture of the channel member. As a result, the work surface may be locked into a fixed position relative to the frame when the latch is received within the aperture of the channel member.

It is a primary object of this invention to provide a simple and more efficient adjustment mechanism for a work surface.

It is another object of this invention to provide an adjustable work surface assembly that is relatively simple in construction and that can be rapidly adjusted with little effort.

It is a further object of this invention to provide vertical and horizontal adjustment mechanisms that are more cost efficient to manufacture and yet provide a reliable mechanism.

This invention, together with attendant objects and advantages, will be best understood with reference to the detailed description below read in conjunction with the accompanying drawings.

BRIEF DESCRIPTION OF THE DRAWINGS

FIG. 1 is a perspective view of an adjustable work surface assembly according to a first embodiment of the present invention with the work surface being shown partially broken away and in shadow;

FIG. 7 is a perspective view of an adjustable work surface assembly according to a second embodiment of the present invention with the work surface being shown partially broken away and in shadow;

FIG. 8 is a lower perspective of the adjustable work surface of FIGS. 1–7 having the horizontal adjustment mechanism exploded from the work surface and the lock attached to the bottom surface of the work surface;

FIG. 9 is an exploded view of the horizontal adjustment mechanism;

DETAILED DESCRIPTION OF THE PREFERRED EMBODIMENTS

Figure 3:
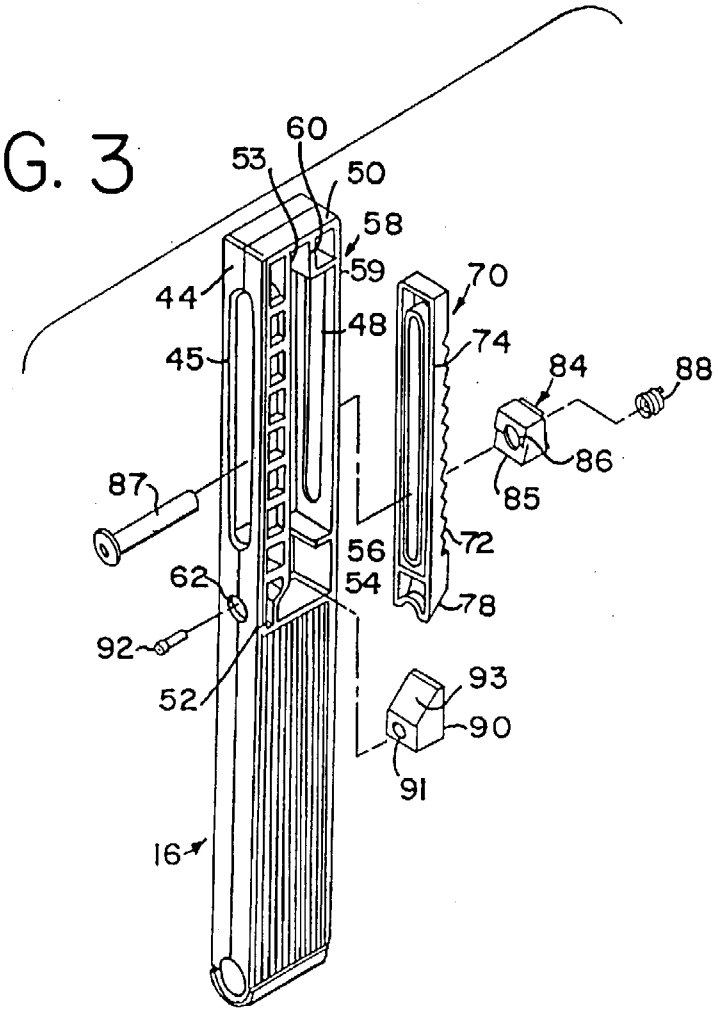
FIG. 3 is an exploded view of the leg shown in FIGS. 1–2.

Referring to the drawings, FIG. 1 shows an adjustable work surface assembly 10 having a work surface 12, a frame 14 and legs 16 in accordance with a first embodiment of the present invention. The work surface 12 may be composed of materials such as wood, particle board or high pressure laminates such as formica or other similar materials. Preferably, the frame 14 is made from a rigid and durable material such as steel or other similar materials. Similarly, the leg 16 is preferably formed from a durable plastic material such as the plastic material known as RYNITE™, type "530 FR", available from the DuPont Corporation of Wilmington, Del.

Figure 2:
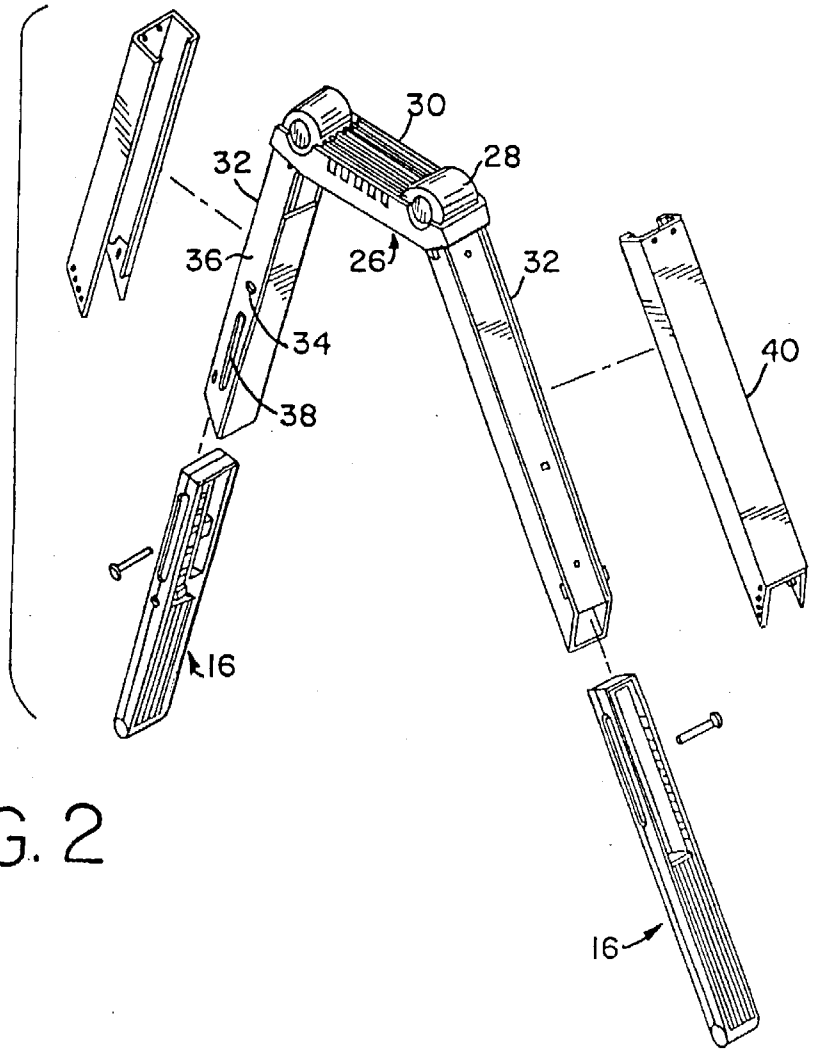
FIG. 2 is an exploded view of the frame and legs shown in FIG. 1.

As shown in FIG. 1, the work surface 12 has a first end 18 and a second end 20 being supported by the frame 14 and the legs 16. The frame 14 includes two tubes 22 that interconnect the ends 26 of the frame 14 to one another. Clamps 28, on the horizontal top portion 30 of each end 26 of the frame 14, serve to secure the tubes 22 to the ends 26 of the frame 14. As better seen in FIG. 2, two sleeves 32 extend downward from the top portion 30 of each end 26 of the frame 14. The sleeves 32 function to movably receive the legs 16. An aperture 34 opens from the side 36 of the sleeve 32. Also, a slot 38 extends along the side 36 of the leg 16 beneath the aperture 34. A cover 40 is attached over the surface of the sleeve 32 in order to provide a more attractive appearance for the sleeve 32.

The legs 16 are movably secured within the sleeve 32 of the frame 14. As best seen in FIG. 3, the upper portion 44 of the leg 16 includes a slot 45. The slot 45 extends across the width of the leg 16 and through the cavity 48. The cavity 48 extends from approximately the top 50 of the leg 16 to the middle of the leg 52. The cavity 48 is further defined by an inner wall 53 and an outer wall 54. The outer wall 54 forms a portion of the outer wall of the leg 16.

The cavity 48 includes a first support surface 56 and a second support surface 58. The first support surface 56 extends inward and substantially perpendicular to the outer wall 54 of the cavity 48. The first support surface 56 is formed in a lower portion of the cavity 48. The second support surface 58 includes a first wall 59 that extends inward and substantially perpendicular to the outer wall 54 of the cavity 48 and a second wall 60 that extends upward from the end of the first wall 59. As a result, the second support surface 58 has a generally L-shaped appearance. The second support surface 58 extends from an upper portion of the cavity 48. The lower portion of the leg further includes an aperture 62 that extends just beneath the slot 45.

Figure 4:
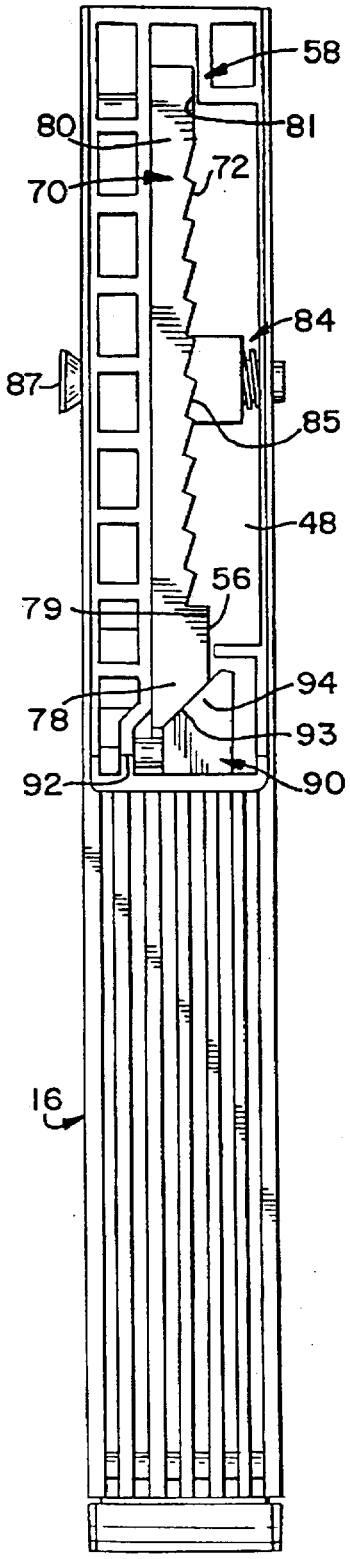
FIG. 4 is a partial cross-section of the frame and leg shown in FIGS. 1–3 with the interlocking block secured to the rack in a first position and the wedge secured against the end of the rack in a first position thereby fixing the work surface at a first height.
Figure 5:
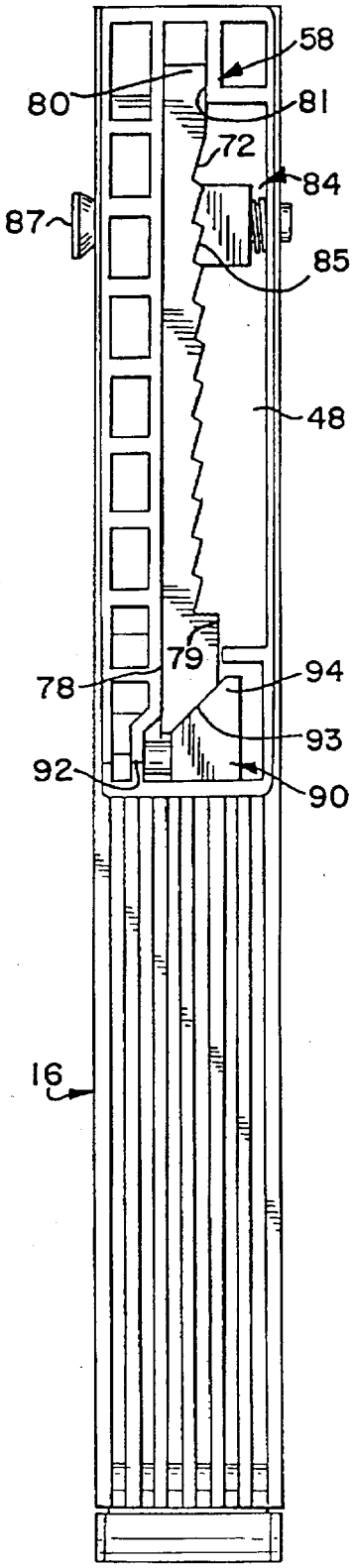
FIG. 5 is a partial cross-section of the frame and leg shown in FIGS. 1–4 with the interlocking block secured to the rack in a second position and the wedge secured against the end of the rack in a first position thereby fixing the work surface at a second height.
Figure 6:
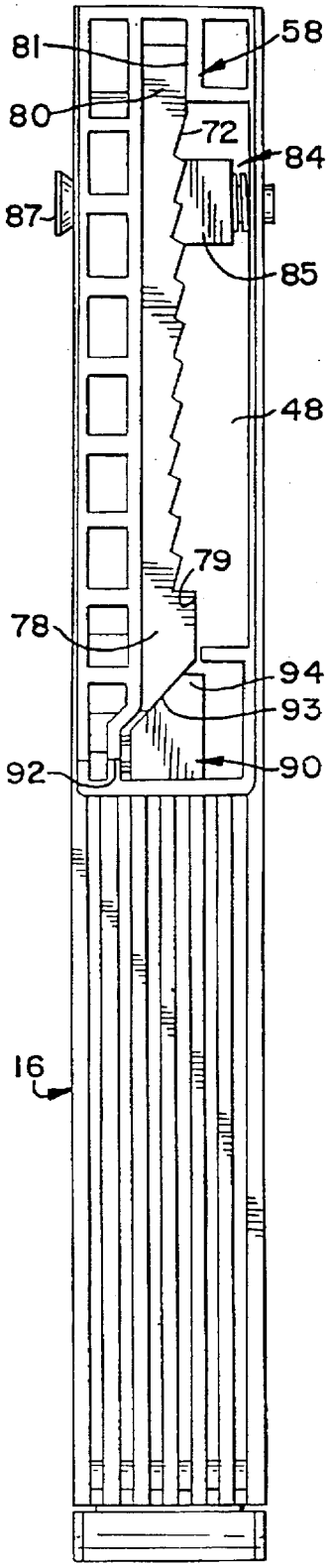
FIG. 6 is a partial cross-section of the frame and leg shown in FIGS. 1–5 with the interlocking block secured to the rack in the second position and the wedge secured against the end of the rack in a second position thereby fixing the work surface at a third height.

The rack 70 is slidably positioned against the inner wall 53 of the cavity 48. A series of outwardly directed teeth 72 extend toward the outer wall 54 of the cavity 48. As best seen in FIG. 3, a centrally located slot 74 extends along a large portion of the length of the rack 70. As best seen in FIGS. 4–6, the lower portion 78 of the rack 70 includes a flat surface 79 that is slidably positioned against the first support 56 that is formed in a lower portion of the cavity 48. The upper portion 80 of the rack 70 similarly includes a flat surface 81 that is slidably positioned against the second support surface 58 and more particularly, the second wall 60. Preferably, the rack 70 is manufactured from a nylon material that is 30% glass-filled.

As shown in FIGS. 3–6, an interlocking block 84 that mates with the teeth 72 of the rack 70 is also positioned within the cavity 48. The block 84 has teeth 85 that oppose corresponding teeth 72 in the rack 70. A centrally located aperture 86 extends through the block 84. A threaded brass insert (not shown) may be positioned within the aperture 86 in order to provide threads that receive a first fastening mechanism, i.e., the screw 87. A biasing mechanism, i.e., the spring 88, is also positioned within the aperture 86 in order to bias the block 84, and more particularly, the teeth 85 against the teeth 72 of the rack 70.

A wedge 90 is movably positioned against the lower portion 78 of the rack 70 within the cavity 48. A centrally located aperture 91 extends through the wedge 90. Similar to the block 84, a threaded brass insert may be positioned within the aperture 86 in order to provide threads that receive a first fastening mechanism, i.e., the screw 92. The wedge 90 has an upwardly angled top surface 93 that slidably engages a correspondingly angled surface 94 on the lower portion 78 of the rack 70. Preferably, both the block 84 and the wedge 90 are made from a plastic material such as DELRIN™, which is available from the DuPont Corporation.

In operation, the height of work surface 12 is determined by the relative positioning of the block 84 against the rack 70 and the wedge 90 against the end of the rack 70. In particular, the screw 87 passes through the aperture 34 of the frame 14 and the slots 45 and 74 of the leg 16 and the rack 70, respectively. The threaded end of the screw 87 is received within the threads of the block 84. When the screw 87 is received within the block 84, the screw may be rotated in a first direction in order to draw the block 84 into engagement with the rack 70. Alternatively, by rotating the screw 87 in the opposite direction, the screw 87 allows for the block 84 to be disengaged from the rack 70. In particular, while the spring 88 biases the block 84 into engagement with the rack, a user may push against the screw 87 toward the frame 14 and the leg 16 thereby disengaging the block 84 from the rack 70. Accordingly, the block 84 can be repositioned at another location on the rack 70.

For example, FIGS. 4 and 5 show the block 84 positioned at a first position in FIG. 4 and a second position in FIG. 5. The work surface 12 is thereby positioned at a first height in FIG. 4 and a second height in FIG. 5. The above-described adjustment procedure allows a large range of height adjustment for the work surface assembly 10.

Once the work surface has been positioned at a given height, a user may fine tone the exact height of the work surface 12 through the relative positioning of the wedge 90 against the end of the rack 70. Specifically, the screw 92 passes through the slot 30 of the frame 14 and aperture 62 of the leg 16. The threaded end of the screw 92 is received within the threads of the wedge 90. When the screw 92 is received within the wedge 90, the screw may be rotated in a first direction in order to draw the wedge against the end of the rack 70. In particular, the upper surface 93 of the wedge 90 forces the rack 70 upward as the screw 92 is rotated thereby slightly increasing the overall height of the work surface 12. Alternatively, by rotating the screw 92 in the opposite direction, the screw 87 allows for the rack 70 to be lowered thereby slightly decreasing the overall height of the work surface 12.

For example, FIGS. 5 and 6 show the wedge 90 positioned at a first position in FIG. 5 and at a second position in FIG. 6. The work surface 12 is thereby positioned at a first height in FIG. 5 and a second height in FIG. 6. The above-described adjustment procedure allows for a finer range of height adjustment for the work surface assembly 10.

FIG. 7 shows a second embodiment of the invention shown in FIGS. 1–6. The work surface assembly 110 is similar to the invention of FIG. 1–6 except for the formation of the frame 114. In particular, the frame 114 has a first end 116 that is shaped like the numeral 7 when viewed from the second end 118. As a result, only one sleeve 120 and leg 122 support the first end 116 of the work surface 124. A foot 126 extends from the leg 122 in order to provide stability for the first end 116 of the work surface. While the embodiment of FIG. 7 has a different frame 114 than that of FIGS. 1–6, the height-adjustment mechanism is generally the same as that described above.

Turning to FIG. 8, the horizontal adjustment mechanism 200 of the present invention is shown exploded from the bottom surface 202 of the work surface 12. The lock 204 is shown attached to the bottom surface 202. As better shown in FIGS. 9 and 11, the horizontal adjustment mechanism 200 includes the channel member 210, the slide 212 and glide blocks 214. The channel member 210 has a substantially flat bottom surface 220 that is attached across the tubes 22. As shown in FIG. 1, a curved collar 222 having a flat upper surface may interconnect the bottom surface 220 of the channel member 210 to the tubes 22. Two upwardly extending side walls 224 extend from the bottom surface 220 and two top walls 226 extend inward from the side walls 224.

Figure 11:
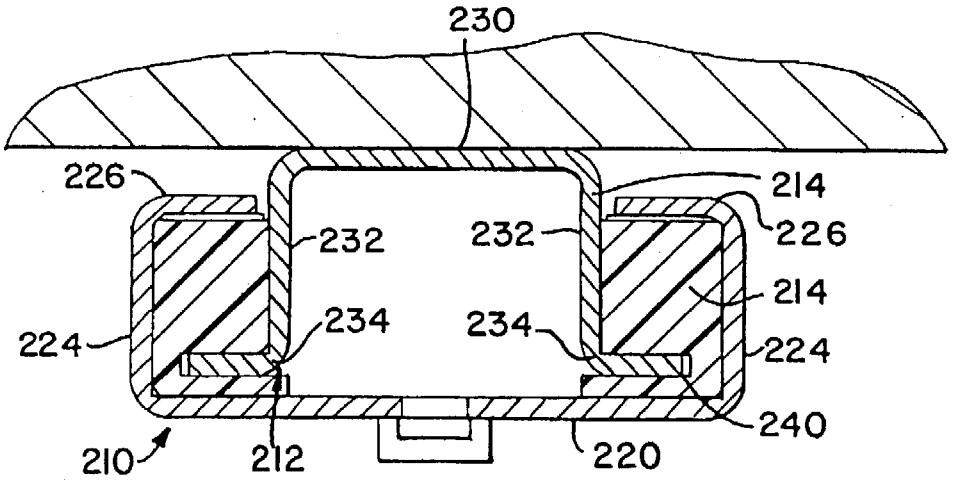
FIG. 11 is a partial cross-sectional view of the horizontal adjustment mechanism taken through the glide blocks as taken through the lines 11—11 of FIG. 1.

As shown in FIGS. 9 and 11, the hat-shaped slide 212 and more specifically, the top surface 230 is fastened to the bottom surface 202 of the work surface 12. The slide 212 has two downwardly directed side walls 232 that are received within the opposing side walls 224 of the channel member 210. Two outwardly projecting walls 234 are movably received within the blocks 214 which are fixed within the channel member 210. The channel member 210 and slide 212 are connected to the frame 14 and work surface 12, respectively, through conventional fastening mechanisms such as screws or the like. Preferably, the channel member 210 and the slide 212 are made from a durable material such as steel.

A pair of glide blocks 214, as shown in cross-section in FIG. 11, are attached to the channel member 210 and the slide 212. More particularly, the glide blocks 214 are connected to the slide 212 through the channels 240 that receive the outwardly projecting walls 234 of the channel member 210. A second pair of glide blocks 214 may be attached to the slide 212 so as to be movable with slide 212. Preferably, the slide blocks 214 are made from a material having a low coefficient of friction such as nylon.

The work surface 12 is horizontally adjustable, once the below-described lock 204 is disengaged. In particular, the slide 212 and work surface 12 are movable with respect to the channel member 210 and the frame 14. More specifically, the outwardly projecting walls 234 slide within the channels 240 of the glide blocks 214 in order to allow the work surface 12 to move away from the central positioning shown in FIG. 1.

Figure 10:
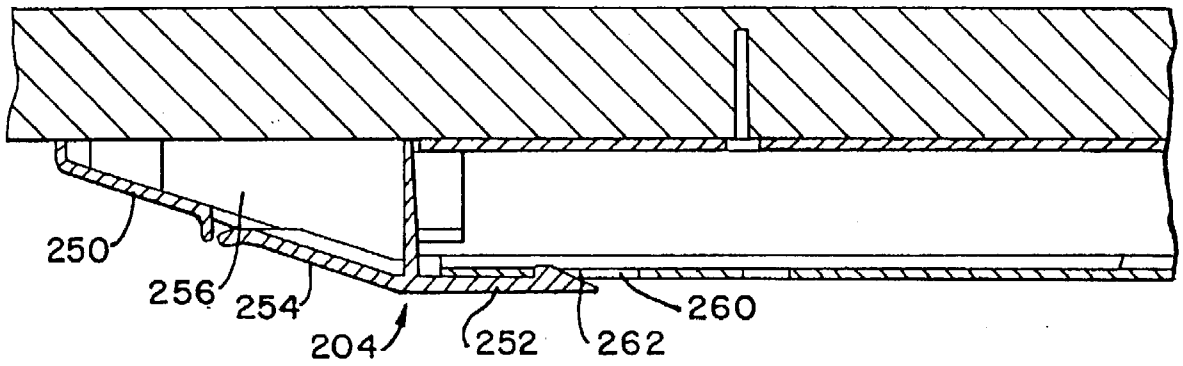
FIG. 10 is a partial cross-sectional view of the lock shown engaged with the horizontal adjustment mechanism as taken through the lines 10—10 of FIG. 1.

As shown in FIGS. 8 and 10, the lock 204 functions to secure the work surface 12 in the central position illustrated in FIG. 1. In particular, the lock 204 includes a body 250 and latch member 252 that are attached via a fastening mechanism, i.e., screws 253 to the bottom surface 202 of the work surface 12. The lock 204 is made from a semi-resilient material (e.g. nylon) such that the actuation member 254 may be easily depressed by a user. A cavity 256 is positioned behind the actuation member 254 so as to receive the actuation member 254 when depressed. When the actuation member 254 is depressed, the latch member 252 and more particularly, the raised surface 262, pivots out from engagement with the aperture 260 located in the bottom wall 220 of the channel member 210. Accordingly, when the latch member 252 is disengaged from the channel member 210, the slide 212 and more generally, the work surface 12, is movable with respect to the channel member 210 and the frame 14. Accordingly, the work surface 12 may be moved to allow a user to gain access to those areas behind or generally beneath the work surface. For example, this feature is particularly useful in connection with allowing a user to gain access to a power cable that may be positioned beneath the work surface 12.

The embodiments described above are illustrative and not restrictive. The scope of the invention is indicated by the claims rather than by the foregoing description. The invention may be embodied in other specific forms without departing from the spirit of the invention. Accordingly, any changes which come within the scope of the claims are intended to be embraced therein.

We claim:

1. A height-adjustable work surface assembly comprising:

a movable work surface;

a frame extending from beneath the work surface in order to provide support for the work surface, the frame having a support member directed downward from beneath the work surface;

a leg adjustably connected to the support member wherein a slot extends along a portion of a length of the leg;

a rack connected to one of the support member and the leg, the rack having a plurality of substantially horizontally extending teeth wherein a slot extends along a portion of a length of the rack;

an interlocking block positioned adjacent the rack and within a cavity formed between the rack and the leg, the interlocking block being movable into and out of engagement with the rack;

the cavity being formed in the leg between the rack and an outer wall of the leg, the cavity having a width greater than a width of the interlocking block and a width of one of the teeth; and a first fastening mechanism connected to the interlocking block and passing through the slots in the rack and leg, the first fastening mechanism horizontally movable such that the interlocking block is secured against the rack in a locked position and completely disengaged from the rack in an unlocked position.

2. The height-adjustable work surface assembly of claim 1 further comprising a wedge received within the cavity and adjacent an end of the rack, the wedge having an angled surface positioned against the end of the rack, the end of the rack having an angled surface substantially corresponding to the angled surface of the wedge.

3. The height-adjustable work surface assembly of claim 2 further comprising a second fastening mechanism extending through the leg, and fastened to the wedge in order to movably position the wedge against the end of the rack.

4. The height-adjustable work surface assembly of claim 3 wherein the teeth of the rack mate with opposing teeth extending inwardly from the block.

5. The height-adjustable work surface assembly of claim 4 wherein the cavity is defined by an inner wall and the outer wall, the rack being movably secured against the inner wall.

6. The height-adjustable work surface assembly of claim 5 wherein the cavity includes a first support and a second support extending from the outer wall toward the inner wall, the supports being positioned against a flat upper portion and a flat lower portion of the rack in order to hold the rack against the inner wall of the cavity.

7. The height-adjustable work surface assembly of claim 4 further comprising a spring received within an aperture within the block, the spring acting to bias the block against the teeth of the rack.

8. The height-adjustable work surface assembly of claim 7 wherein the first fastening mechanism and the second fastening mechanism comprise a screw that is received by a series of threads within the block and the wedge, respectively.

9. The height-adjustable work surface assembly of claim 8 wherein the angled surface of the rack and the wedge extend substantially upward.

10. A height-adjustable work surface assembly comprising:

a movable work surface;

a frame extending from beneath the work surface in order to provide support for the work surface, the frame having a sleeve directed downward from beneath the work surface;

a leg adjustably received within the sleeve of the frame, the leg having a cavity located therein;

a movable rack having a series of outwardly extending teeth is positioned within the cavity, an end of the rack having an angled surface;

an interlocking block having teeth opposing the rack in order to mate with the teeth of the rack at a given position, the block being positioned adjacent the rack;

a wedge slidably engaged with the end of the rack, the angled surface of the rack corresponding to an angled upper surface of the wedge;

a first fastening mechanism extending through the sleeve and the leg, and movably fastened to the block in order to secure the block in a given position against the rack; and a second fastening mechanism extending through the sleeve and the leg and movably fastened to the wedge in order to secure the wedge in a given position against the end of the rack;

whereby the work surface height may be adjusted by the relative positioning of the leg within the sleeve of the frame as determined by the relative positioning of the block along the length of the rack and the wedge against the end of the rack.

11. The height-adjustable work surface assembly of claim 10 wherein a slot extends across the leg, the slot adapted to receive the first fastening mechanism.

12. The height-adjustable work surface assembly of claim 11 wherein a centrally located slot extends within the rack, the slot of the rack adapted to receive the first fastening mechanism and being in communication with the slot of the leg.

13. The height-adjustable work surface assembly of claim 12 wherein apertures within the frame and the block further receive the first fastening mechanism.

14. The height-adjustable work surface assembly of claim 13 wherein a slot within the frame and an aperture within the wedge receive the second fastening mechanism.

15. The height-adjustable work surface assembly of claim 14 wherein the first and second fastening mechanisms comprise a first screw and a second screw, respectively.

16. The height-adjustable work surface assembly of claim 15 wherein threads within the apertures of the block and the wedge receive the first screw and the second screw.

17. A height-adjustable work surface assembly comprising:

a moveable work surface;

a frame extending from beneath the work surface in order to provide support for the work surface, the frame having a sleeve directed downward from beneath the work surface, the sleeve having an aperture and a slot extending thereacross, the aperture being located above the slot;

a leg adjustably received within the sleeve of the frame, the leg having a cavity located therein and a slot extending along an upper portion of the first leg and through the cavity, the slot being in communication with the aperture within the sleeve of the frame;

a movable rack having a series of outwardly extending teeth is positioned within the cavity, the rack having a centrally located slot extending therein, the slot being in communication with the slot of the leg and the aperture of the first sleeve, the lower end of the rack having an angled surface;

an interlocking block that mates with the teeth of the rack, the block having an aperture that is in communication with the slots of the rack and the leg and the first aperture of the sleeve;

a wedge slidably engaged with the end of the rack, the wedge having an aperture in communication with the slot of the sleeve and having an angled upper surface positioned against the lower end of the rack, the angled surface of the rack corresponding to the angled surface of the wedge; and first and second fastening mechanisms received within the first and second apertures of the frame, respectively, the first fastening mechanism removably fastened through the first aperture of the frame, the slots of the leg and the rack, to the aperture of the interlocking block, the second fastening mechanism removably fastened through the slot of the frame to the aperture within the wedge whereby the work surface height may be adjusted by the relative positioning of the leg within the sleeve of the frame as determined by the relative positioning of the block along the length of the rack and the wedge against the lower end of the rack.

18. The height-adjustable work surface assembly of claim 17 further comprising a spring received within the aperture of the block, the spring acting to bias the block against the teeth of the rack.

19. The height-adjustable work surface assembly of claim 18 wherein the angled surface of the rack and the block are substantially parallel.

20. The height-adjustable work surface assembly of claim 19 wherein the cavity is defined by an inner wall and an outer wall, the rack being movably secured against the inner wall.

21. A horizontally-adjustable work surface assembly comprising:

a work surface having a top surface and a bottom surface;

a frame extending from beneath the work surface in order to provide support for the work surface, the frame including at least one leg attached thereto;

a first rail attached to the frame, the first rail including an aperture on an end thereof;

a second rail attached to the work surface, the first rail and the second rail being movable relative to one another; and a lock member attached to the bottom surface of the work surface adjacent an end of the work surface and directly adjacent an end of the second rail, the lock comprising a body and a latch member, the latch member adapted to be received within the aperture of the first rail.

22. A horizontally-adjustable work surface assembly according to claim 21 further comprising two slide blocks received within one of the first and second rails, the slide blocks each having opposing channels extending along an inner surface, the channels adapted to receive two outwardly projecting edges of the one of the rails.

23. A horizontally-adjustable work surface assembly according to claim 22 wherein the latch further includes an actuation portion which pivots the latch out from engagement with the aperture.

24. A horizontally-adjustable work surface assembly according to claim 23 wherein the body further includes a cavity opening above the actuation portion of the latch member.

25. A horizontally-adjustable work surface assembly according to claim 24 wherein the latch and body are made from a resilient material.

26. A horizontally-adjustable work surface assembly according to claim 24 wherein the first rail is generally U-shaped and the second rail is generally hat-shaped.

* * * * *